US007617627B1

(12) United States Patent
Waidelich

(10) Patent No.: US 7,617,627 B1
(45) Date of Patent: Nov. 17, 2009

(54) DISPLAY ASSEMBLY

(75) Inventor: John D. Waidelich, Wauseon, OH (US)

(73) Assignee: Archbold Container Corporation, Archbold, OH (US)

( * ) Notice: Subject to any disclaimer, the term of this patent is extended or adjusted under 35 U.S.C. 154(b) by 387 days.

(21) Appl. No.: 11/259,330

(22) Filed: Oct. 26, 2005

(51) Int. Cl.
*G09F 15/00* (2006.01)

(52) U.S. Cl. ..... 40/607.1; 40/652; 40/667

(58) Field of Classification Search ..... 40/607.1, 40/652, 658, 666–667, 607.03, 661, 591; 248/615, 222.11, 222.12; 116/173
See application file for complete search history.

(56) References Cited

U.S. PATENT DOCUMENTS 1,258,941 A * 3/1918 Pease ..... 40/666
1,757,440 A * 5/1930 Sharp ..... 40/658
1,763,024 A * 6/1930 Underhill et al. ..... 40/666
2,018,578 A * 10/1935 Rush ..... 40/311
2,078,866 A * 4/1937 Metz ..... 248/229.16
2,546,855 A * 3/1951 Frame ..... 116/173
3,715,821 A * 2/1973 Hawes ..... 40/591
3,762,360 A * 10/1973 Hawes ..... 116/28 R
4,704,813 A * 11/1987 Fast ..... 40/661.08
4,876,810 A * 10/1989 Piana et al. ..... 40/316
4,899,474 A * 2/1990 Piana et al. ..... 40/316
5,400,992 A * 3/1995 Pohl ..... 248/231.81
D389,259 S * 1/1998 Tichy et al. ..... D20/43
5,799,428 A * 9/1998 Poindexter ..... 40/658
6,295,750 B1 * 10/2001 Harwell et al. ..... 40/661
6,971,201 B2 * 12/2005 Brinkman et al. ..... 40/642.02
7,219,458 B2 * 5/2007 Burlando ..... 40/607.12

* cited by examiner

*Primary Examiner*—William L. Miller
(74) *Attorney, Agent, or Firm*—MacMillan, Sobanski & Todd, LLC

(57) ABSTRACT

A display assembly having at least one foot including a base member with a first end and a second end. A first member extends upwardly from the first end. A second member extends upwardly from the second end. A resilient clamping member extends from the first member toward the second member. A display is positioned adjacent to the second member. The display assembly further includes a display for positioning on the display holder.

17 Claims, 10 Drawing Sheets

FIG. 9
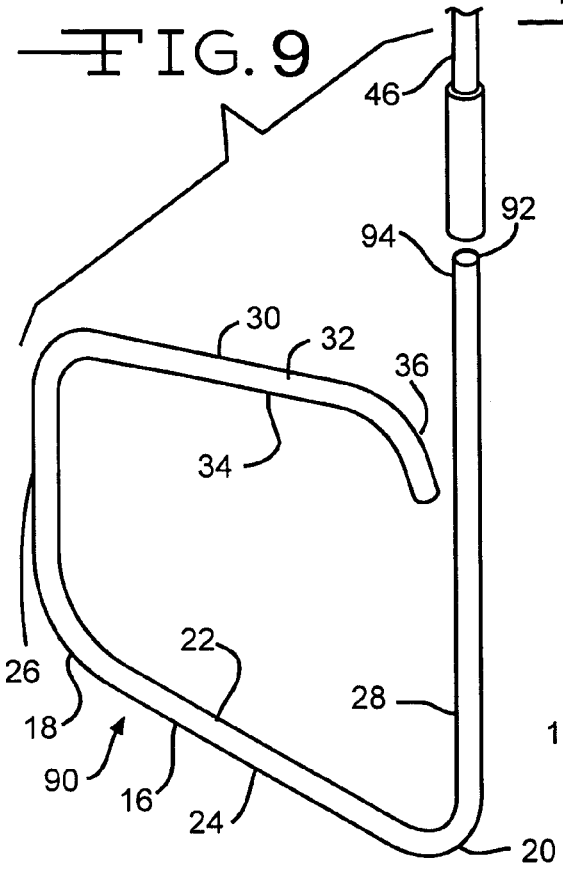
FIG. 10
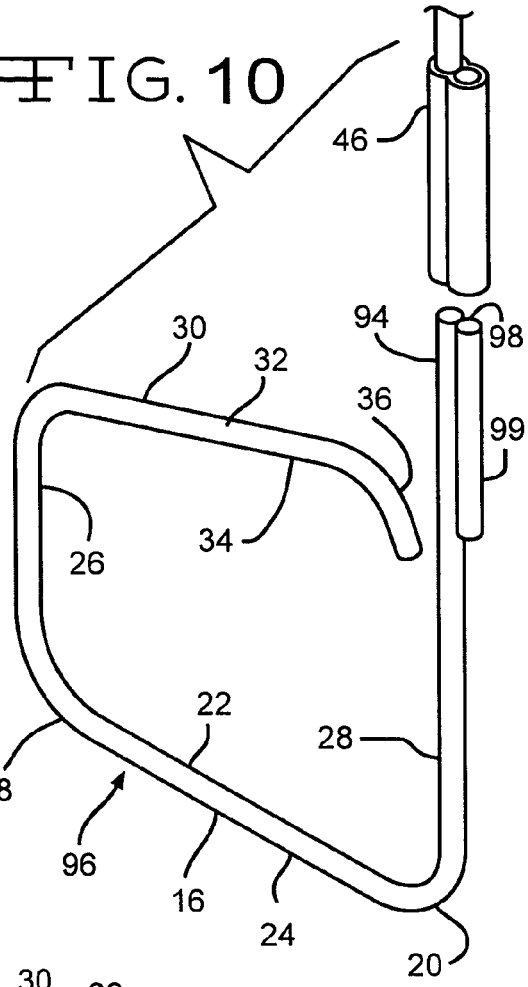
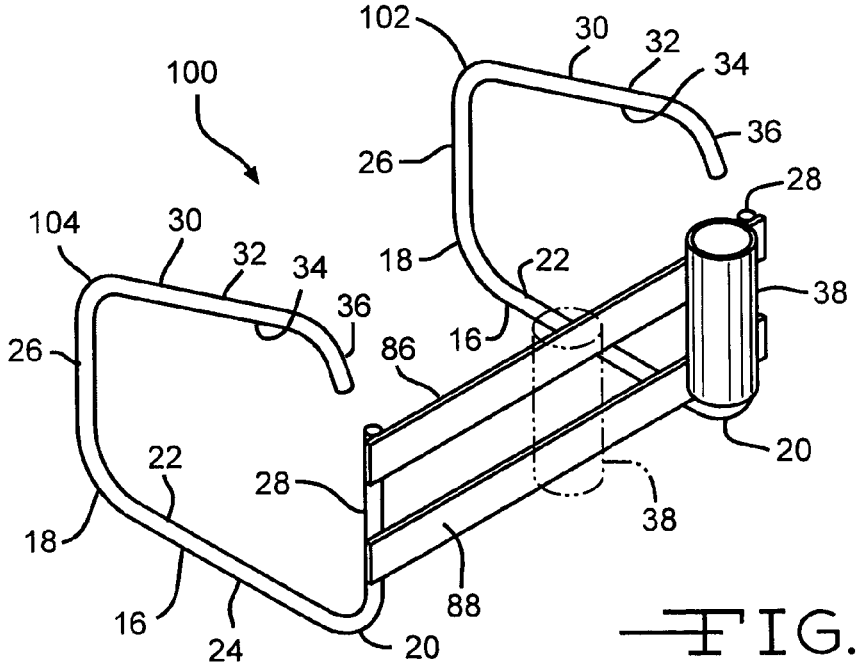
FIG. 11

DISPLAY ASSEMBLY

TECHNICAL FIELD

The invention relates generally to a display assembly. More specifically, the invention is directed to a display assembly having at least one foot for securing the display assembly to an object such as a pallet.

BACKGROUND OF THE INVENTION

Merchandise displayed on a pallet requires displays to provide information about, for example, names of products, names of manufacturers and prices. The present invention provides a display assembly that can be easily attached to and removed from a pallet.

BRIEF SUMMARY OF THE INVENTION

The present invention is a display assembly that has at least one foot having a base member including a first end and a second end. A first member extends upwardly from the first end. A second member extends upwardly from the second end. A resilient clamping member extends from the first member toward the second member. The foot further has a display holder that is positioned adjacent to the second member. The display assembly has a display for positioning on the display holder.

BRIEF DESCRIPTION OF THE DRAWINGS

FIG. 9 is a perspective view of a fifth embodiment foot according to the present invention;

FIG. 10 is a perspective view of a sixth embodiment foot according to the present invention;

FIG. 11 is a perspective view of a seventh embodiment foot according to the present invention;

DETAILED DESCRIPTION OF THE INVENTION

Figure 3:
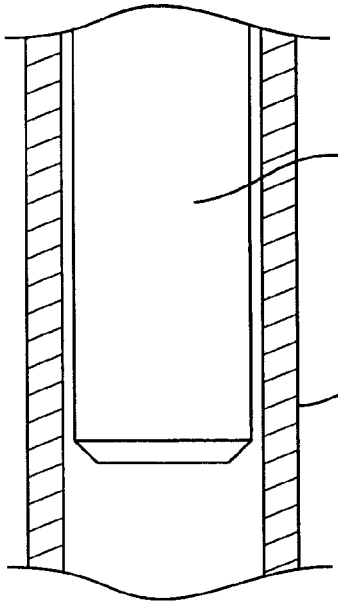
FIG. 3 is a cross-sectional view taken through line 3-3 of FIG. 2.
Figure 4:
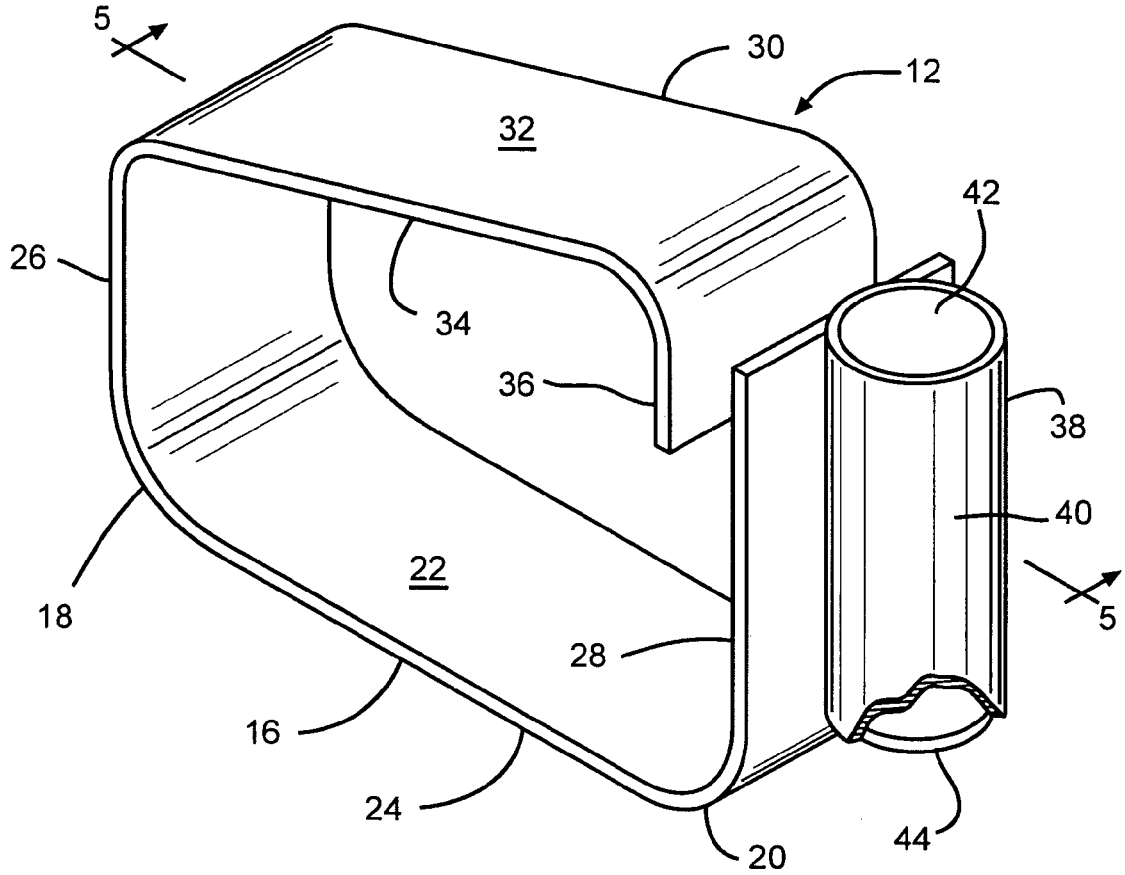
FIG. 4 is a perspective view of a first embodiment foot according to the present invention.
Figure 5:
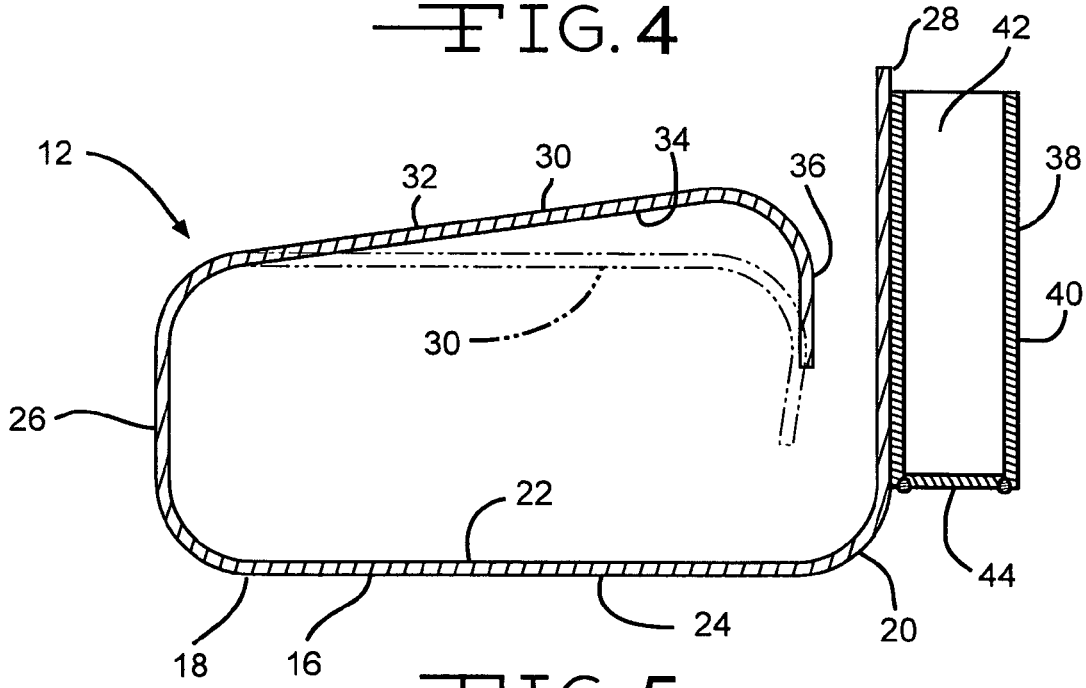
FIG. 5 is a cross-sectional view taken along line 5-5 of FIG. 4.

Referring to FIGS. 1-5, a first embodiment display assembly 10 of the present invention has a first foot 12 and a second foot 14. As shown in FIGS. 4 and 5, the first and second feet 12 and 14, as represented by the first foot 12, each includes a base member 16 having a first end 18, a second end 20, a flat upper surface 22 and flat lower surface 24. A first member 26 extends upwardly from the first end 18 and a second member 28 extends upwardly from the second end 20. The first member 26 and the second member 28 are positioned in an opposed and spaced relationship with respect to one another. A clamping member 30 extends from the first member 26 toward the second member 28. The clamping member 30 and the base 16 are positioned in an opposed and spaced relationship with respect to one another. As shown in FIG. 5, the clamping member 30 is resilient and can be compressed from a normally upwardly biased position to a clamping position as shown in broken lines in FIG. 5. The clamping member 30 has a flat top surface 32 and a flat bottom surface 34. A third member 36 extends downwardly from the clamping member 30 toward the base member 16. The third member 36 and the second member 28 are positioned in an opposed and spaced relationship with respect to one another.

As shown in FIGS. 1-5, each of the first and second feet 12 and 14 includes a display holder 38 positioned adjacent to the second members 28 of the first and second feet 12 and 14. As shown in FIGS. 4 and 5, the display holder 38 is directly connected to the second member 28. The display holder 38 has a cylindrical side wall 40 that defines an opening 42. The display holder 38 further includes a bottom 44.

The first and second feet 12 and 14 are constructed of metal. In alternative embodiments, the first and second feet 12 and 14 can be constructed of plastic.

Figure 1:
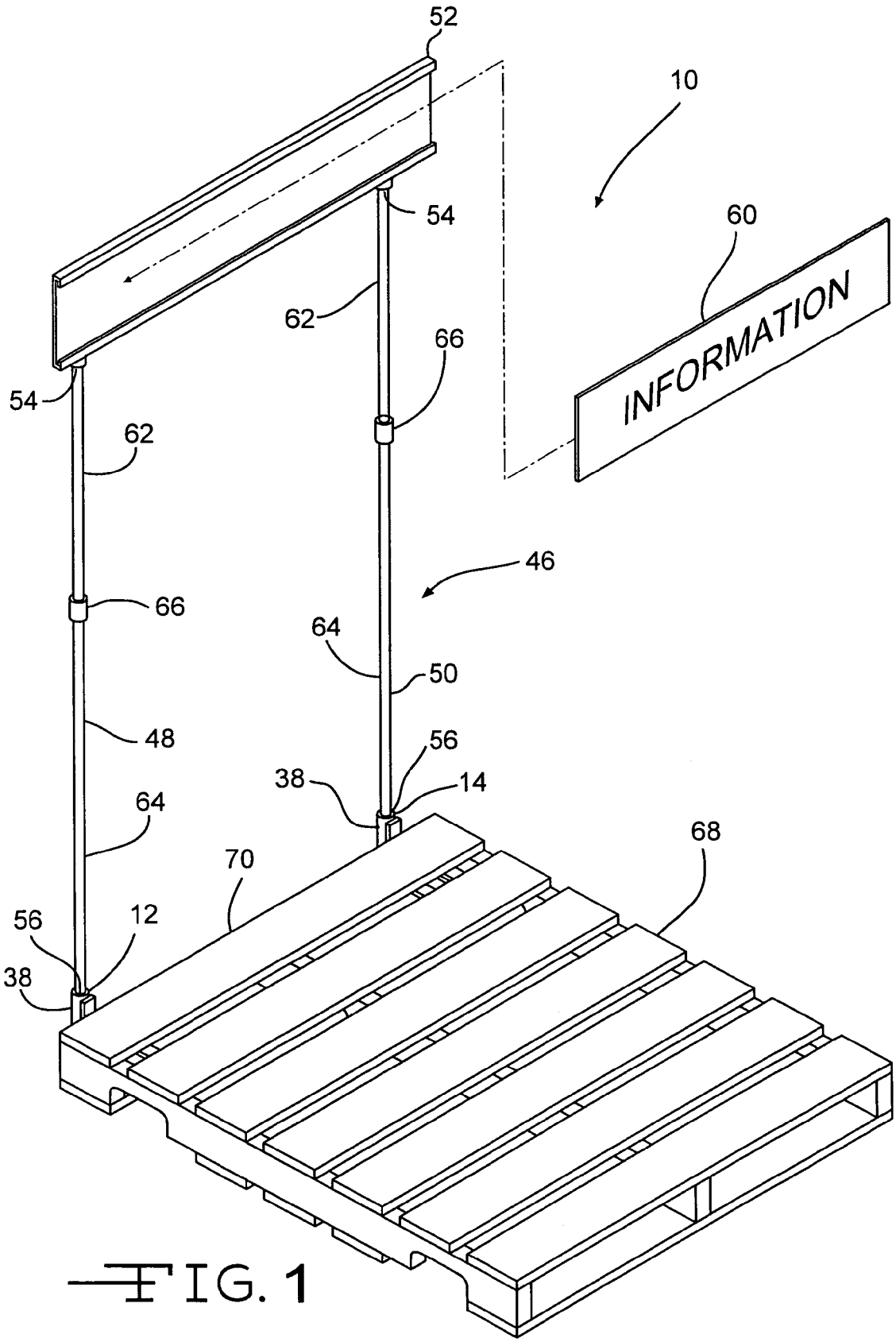
FIG. 1 is a front perspective view of a first embodiment display assembly according to the present invention.
Figure 2:
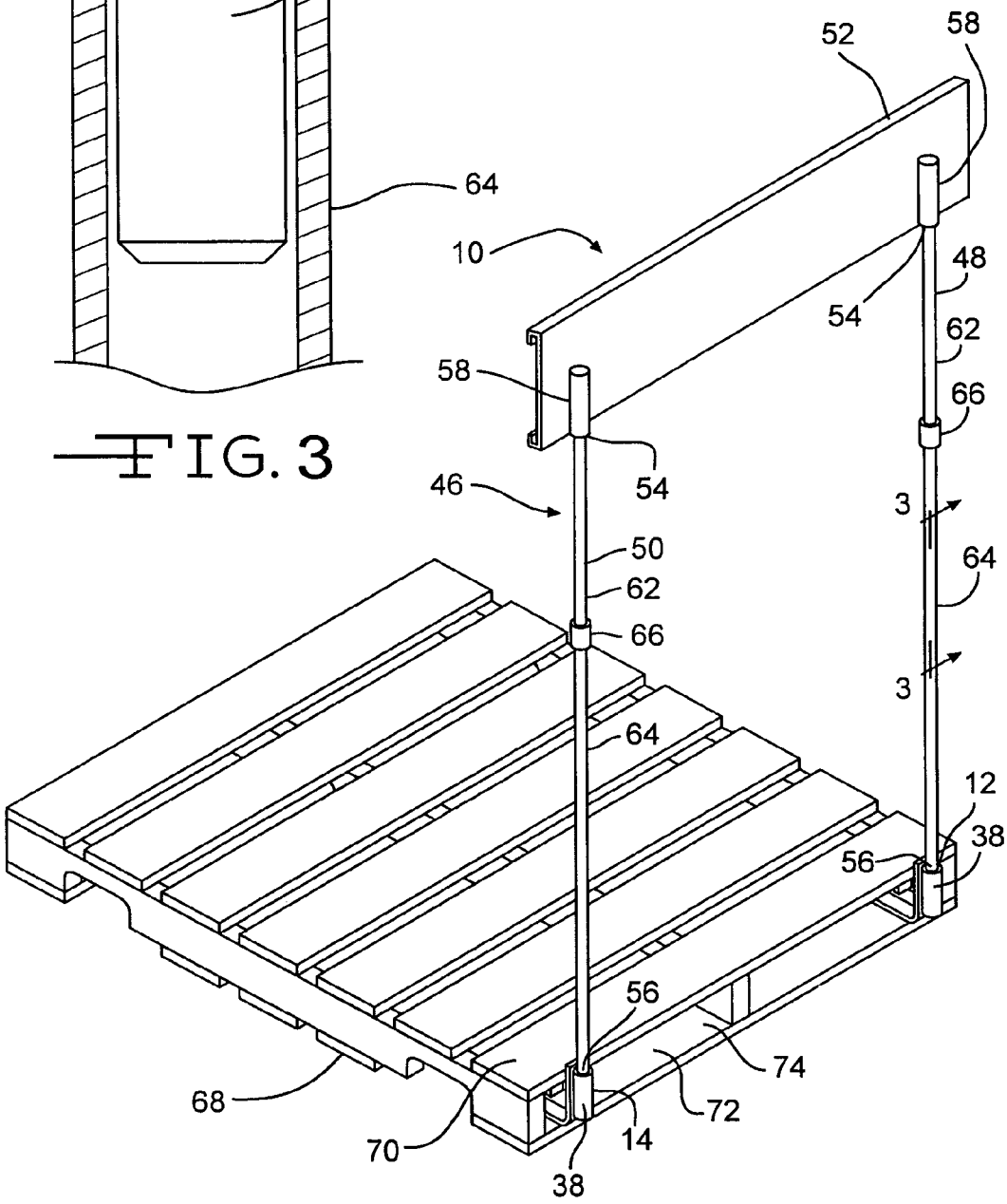
FIG. 2 is a back perspective view of the first embodiment display assembly shown in FIG. 1.

Referring to FIGS. 1-3, the display assembly 10 has a display 46 including a first display support member 48 and a second display support member 50 and a display member 52. Each of the first and second display support members 48 and 50 includes a top 54 and a bottom 56. The tops 54 are sized and adapted to engage a support bracket 58 for the display member 52 that extends between the first and second display support members 48 and 50. The display member 52 has a sign 60 that includes information about, for example, names of products, names of manufacturers and prices. The bottoms 56 of the first and second display support members 48 and 50 are sized and adapted for positioning in the openings 42 of the display holders 38. As shown in FIGS. 1-3, each of the first and second support members 48 and 50 has a first section 62 movably and adjustably positioned in a second section 64. A locking device 66 engages the first and second sections 62 and 64 to prevent movement with respect to one another when they have been adjusted.

As shown in FIGS. 1 and 2, the display assembly 10 is positioned on, for example, a pallet 68 having a top member 70 and an opposed bottom member 72 that define a space 74. As shown in FIG. 2, the first and second feet 12 and 14 are positioned in the space 74 so that the lower surface 24 of the base member 16 engages the bottom member 72 and the top surface 32 of the clamping member 30 engages the top member 70. As the first and second feet 12 and 14 are positioned between the top and bottom members 70 and 72, the resilient clamping member 30, compresses while engaging the top member 70. This provides the display assembly 10 with a firm connection with the pallet 68. This allows the display assembly 10 to be moved with the pallet 68. The display assembly 10 can be easily detached from the pallet 68 by removing the first and second feet 12 and 14 from between the top and bottom members 70 and 72. The clamping member 30 then returns to the upward position shown in FIG. 5. The display assembly 10 can then be reused.

Referring to FIGS. 6-12, alternative embodiments of the foot according to the present invention are shown. The elements as shown in FIGS. 1-5 and described above are common for the alternative embodiments. Accordingly, the reference numbers used in FIGS. 1-5 are used for corresponding elements in FIGS. 6-12.

Figure 6:
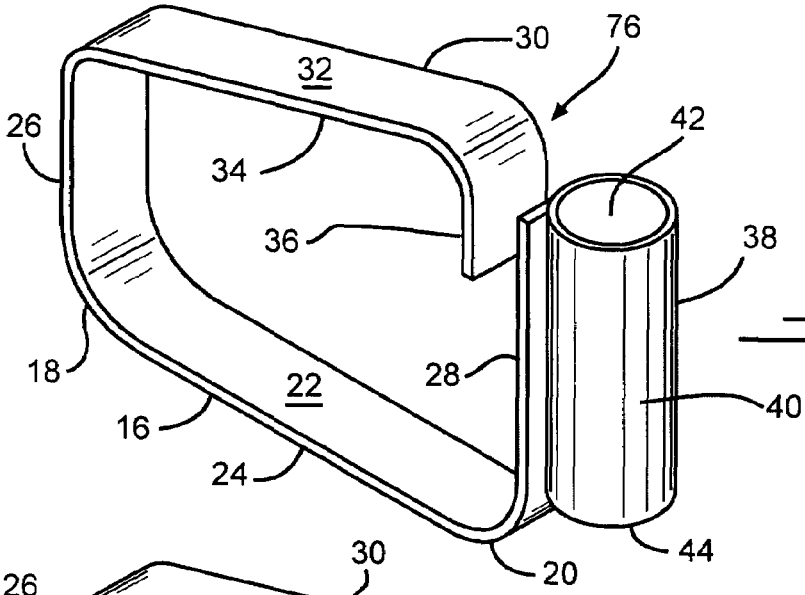
FIG. 6 is a perspective view of a second embodiment foot according to the present invention.

Referring to FIG. 6, a second embodiment foot 76 is shown. In this embodiment, the base member 16, the first member 26, the second member 28 and the clamping member 30 have widths that are one-half those of the first foot 12.

Figure 7:
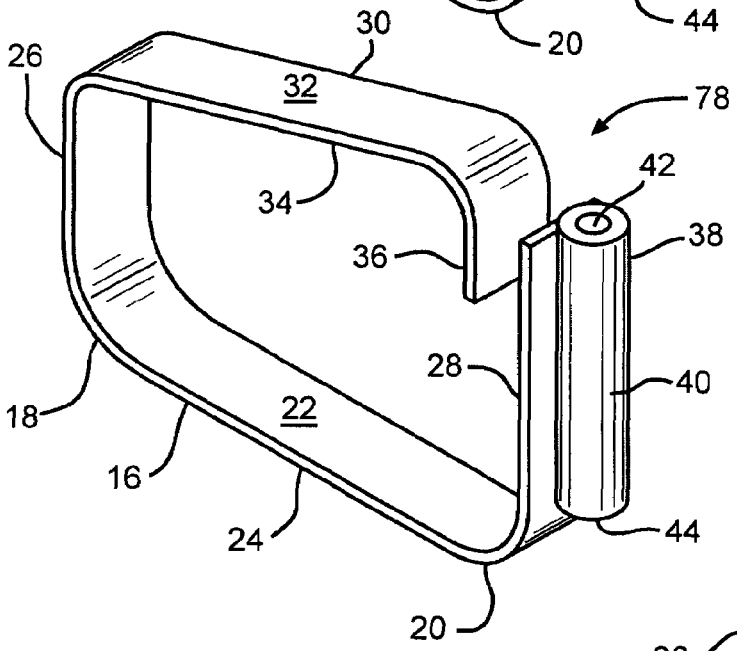
FIG. 7 is a perspective view of a third embodiment foot according to the present invention.

Referring to FIG. 7, a third embodiment foot 78 is shown. In this embodiment, the side wall 40 of the display holder 38 defines a smaller opening 42 than the first foot 12. The opening 42 in this embodiment is sized and adapted for a display 46 constructed of wire.

Figure 8:
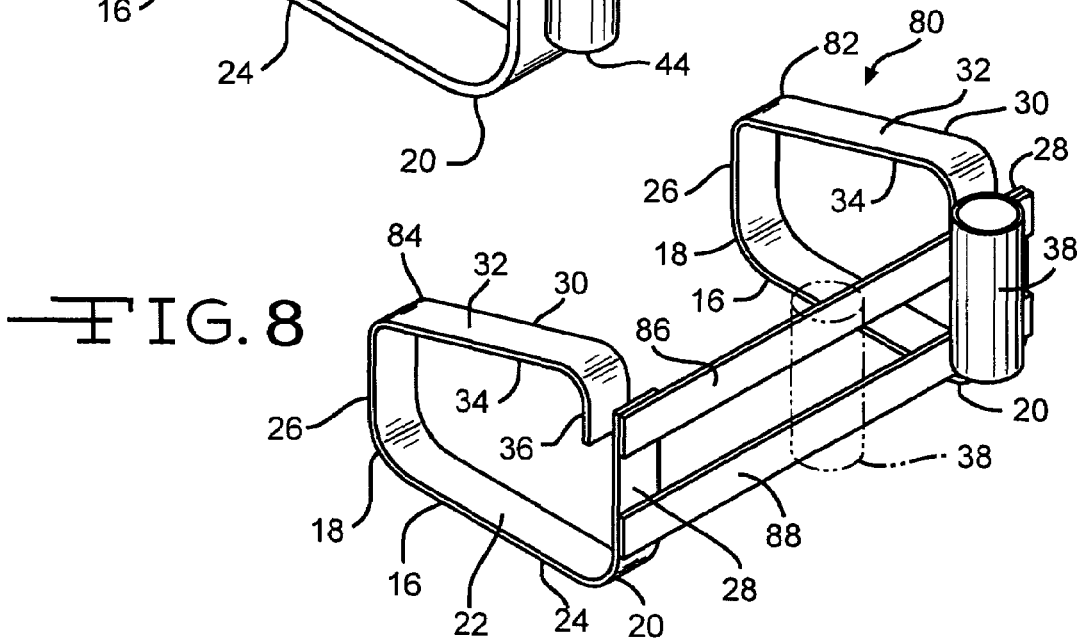
FIG. 8 is a perspective view of a fourth embodiment foot according to the present invention.

Referring to FIG. 8, a fourth embodiment foot 80 has two feet 82 and 84 that are each similar to the first foot 12 shown in FIGS. 4 and 5. In this embodiment, two frame members 86 and 88 extend between the second members 28 of the feet 82 and 84. The display holder 38 is attached to the frame members 82 and 84. The broken lines in FIG. 8 show an alternative positioning of the display holder 38.

Referring to FIG. 9, a fifth embodiment foot 90 is constructed of round wire. Accordingly, the lower surface 24 of the base member 16 and the top surface of the clamping member 30 are rounded. In this embodiment, a display holder 92 is an upper portion 94 of the second member 28 that is sized and adapted for sliding engagement with the display 46.

Referring to FIG. 10, a sixth embodiment foot 96 is similar to the fifth embodiment foot 82. In this embodiment, a display holder 98 is the upper portion 94 of the second member 28 and a cylindrical display engagement member 99 that is attached to the upper portion 94. The upper portion 94 and the display engagement member 99 are sized and adapted for sliding engagement with the display 46.

Referring to FIG. 11, a seventh embodiment foot 100 is similar to the fourth embodiment foot 80 as shown in FIG. 8. In this embodiment, the two feet 102 and 104 are attached to frame members 86 and 88. The broken lines in FIG. 11 show an alternative position of the display holder 38 on the frame members 86 and 88.

Figure 12:
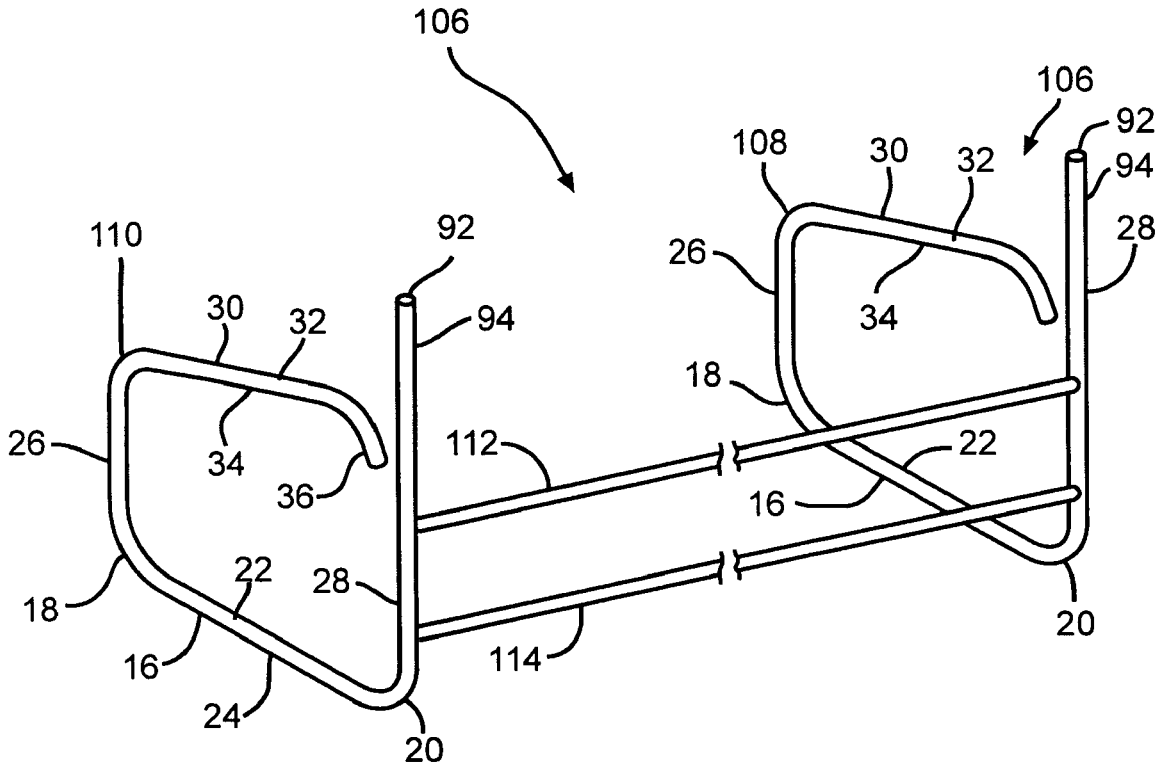
FIG. 12 is a perspective view of an eighth embodiment foot according to the present invention.

Referring to FIG. 12, an eighth embodiment foot 106 has two feet 108 and 110 that are similar to the fifth embodiment foot 90 shown in FIG. 9. Two wire frame members 112 and 114 extend between the second members 28 of the feet 108 and 110.

Referring to FIGS. 13-17, alternative embodiments of the display assembly according to the present invention are shown. The elements as shown in FIGS. 1-12 and described above are common for the alternative embodiments. Accordingly, the reference numbers used in FIGS. 1-12 are used for corresponding elements in FIGS. 13-17.

Figure 13:
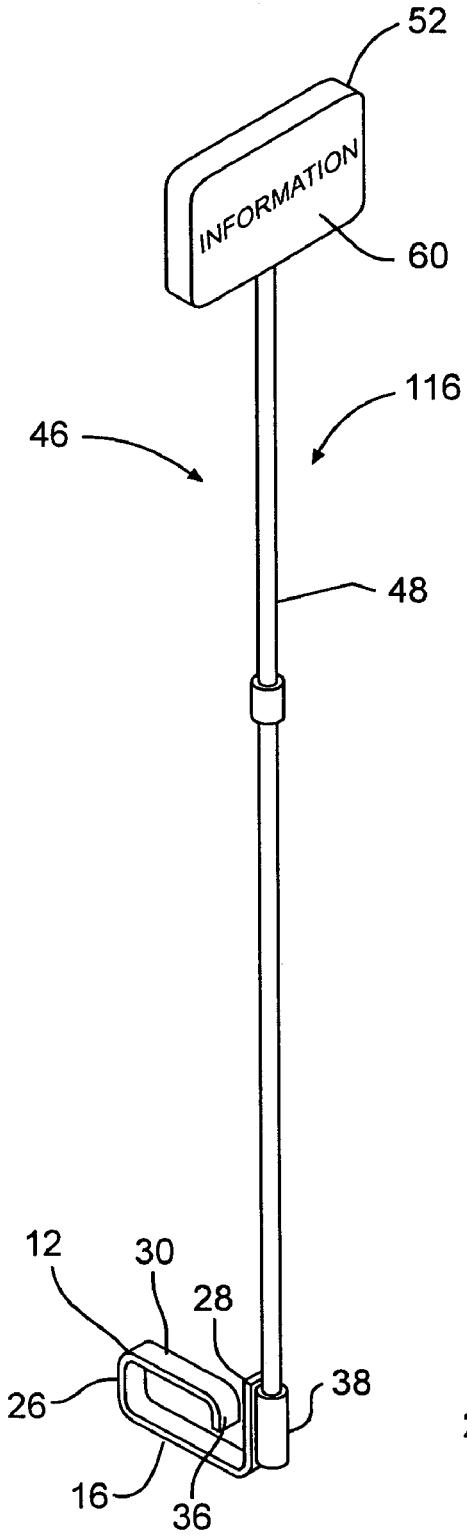
FIG. 13 is a perspective view of a second embodiment display assembly according to the present invention.

Referring to FIG. 13, a second embodiment display assembly 116 has a first foot 12 and a display 46 including a first display support member 48 and a display member 52 having a sign 60.

Figure 14:
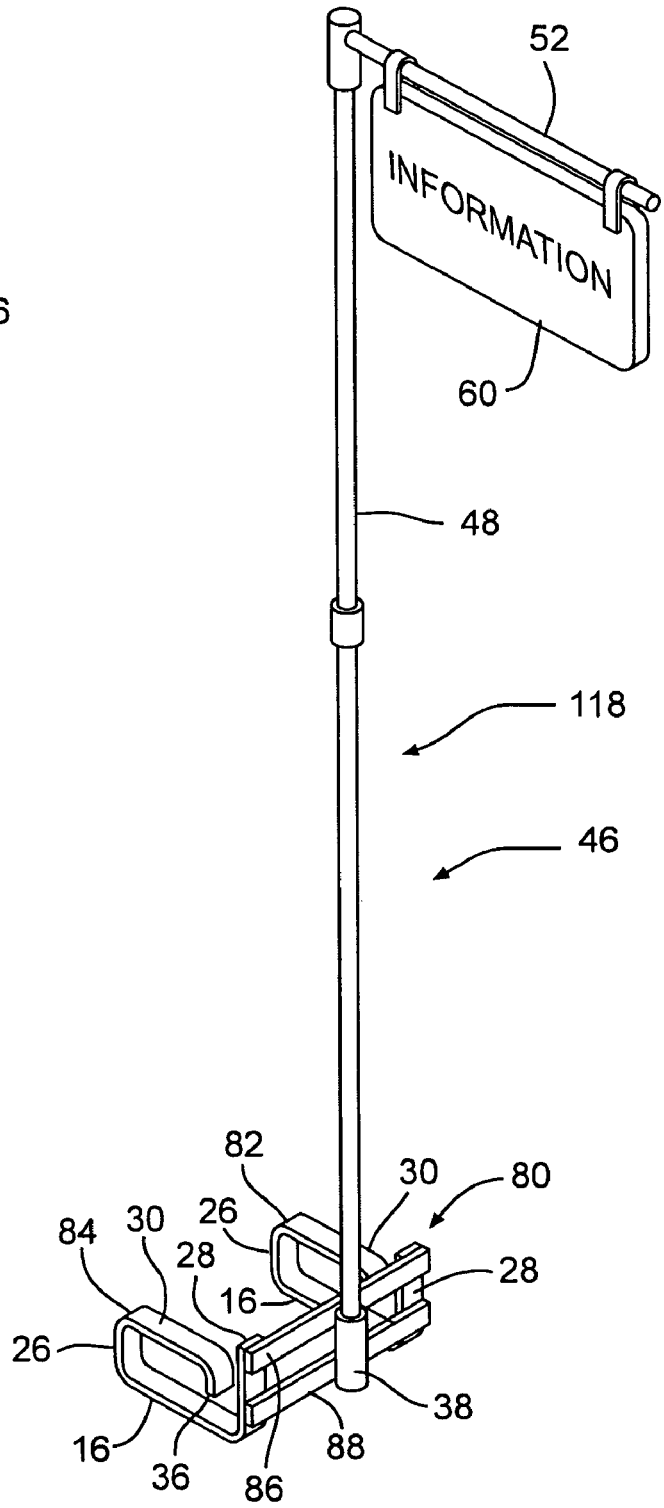
FIG. 14 is a perspective view of a third embodiment display assembly according to the present invention.

Referring to FIG. 14, a third embodiment display assembly 118 has a foot 80 as shown in FIG. 8 and a display 46 including a first display support member 48 and a display member 52 having a sign 60.

Figure 15:
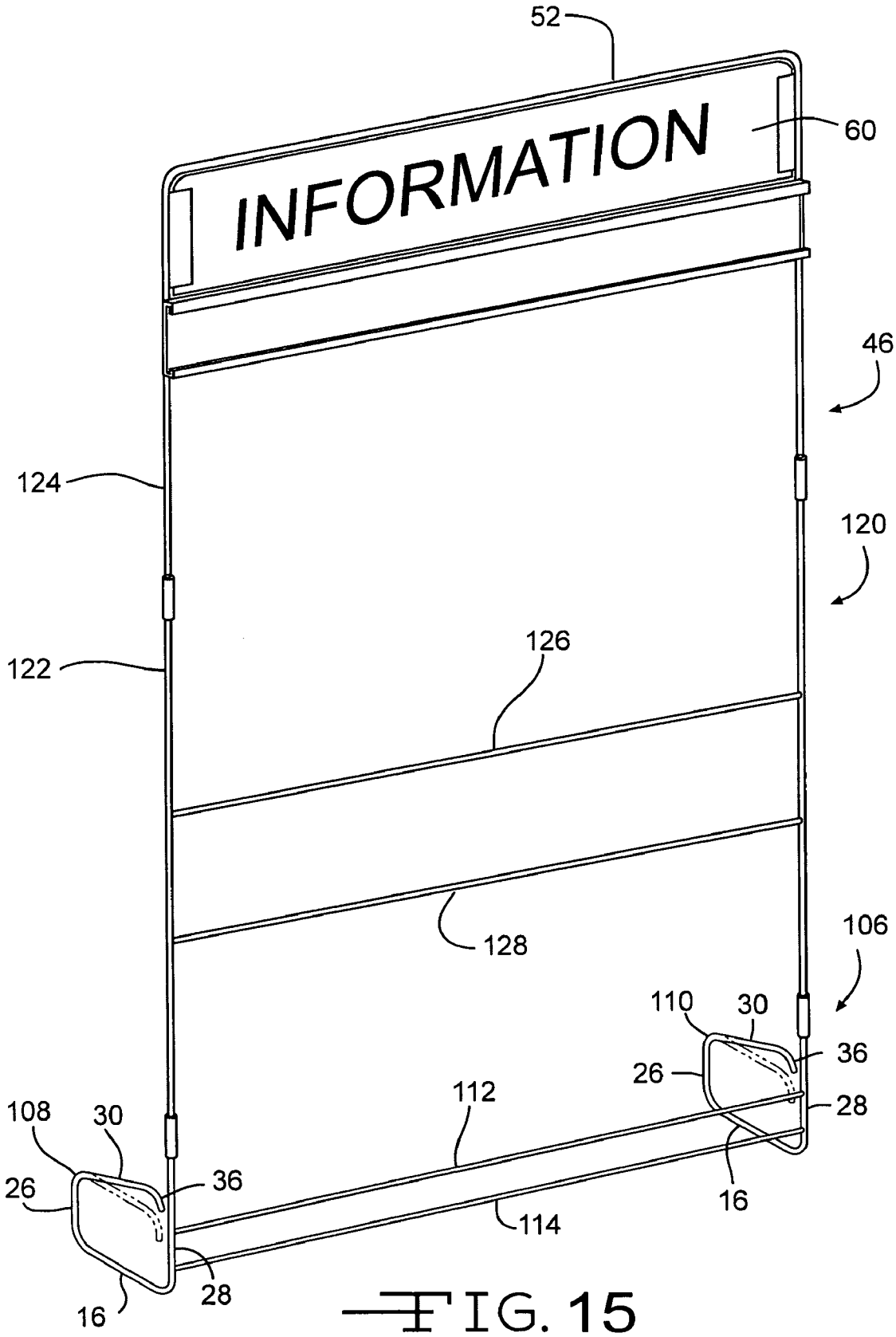
FIG. 15 is a perspective view of a fourth embodiment display assembly according to the present invention.

Referring to FIG. 15, a fourth embodiment display assembly 120 has a foot 106 as shown in FIG. 12 and a display 46 including a first section 122 attached to a second section 124. The first section 122 has two cross members 126 and 128. A display member 52 having a sign 60 is attached to the second section 124. The first section 122, the second section 124 and the two cross members 126 and 128 are constructed of wire.

Figure 16:
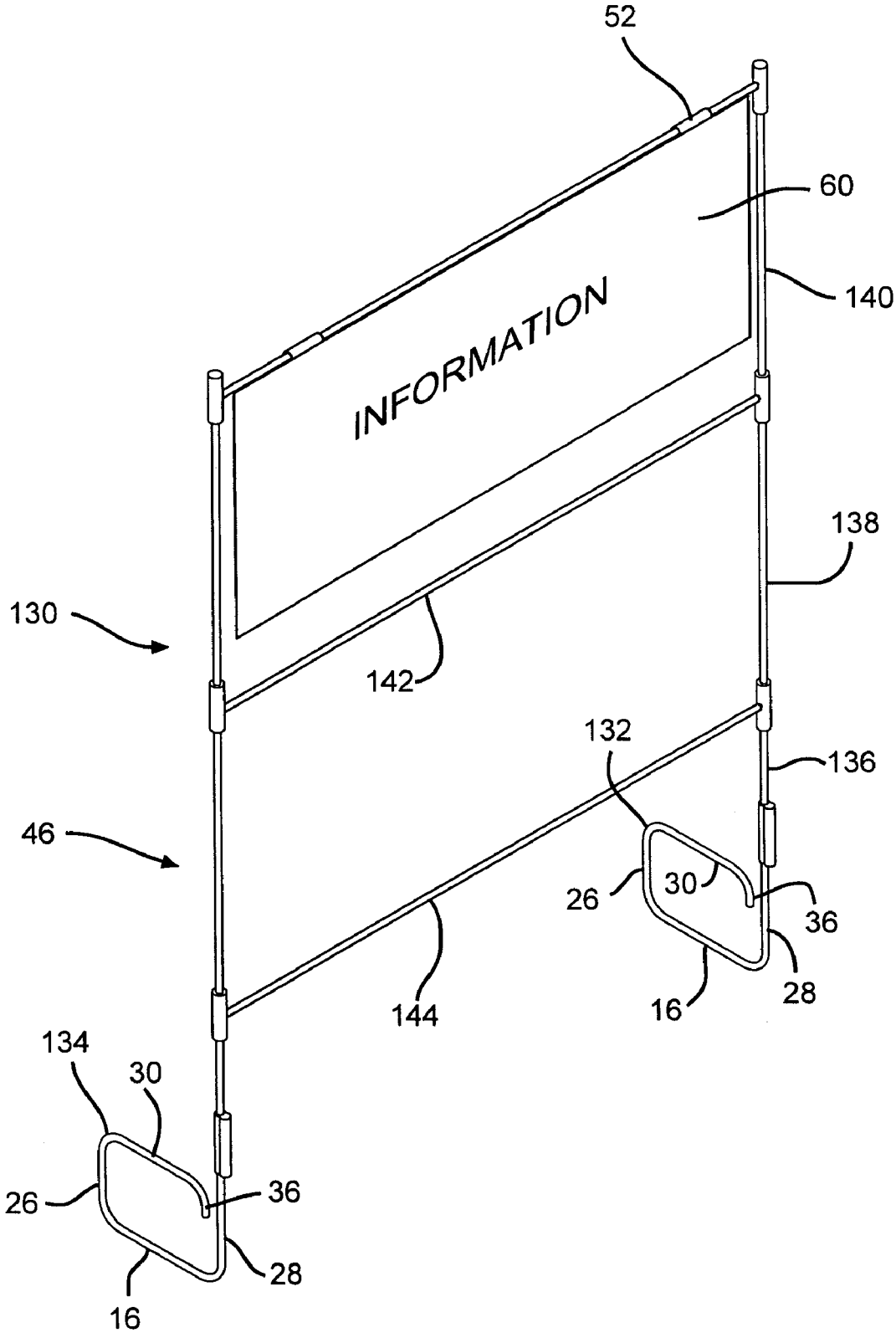
FIG. 16 is a perspective view of a fifth embodiment display assembly according to the present invention.

Referring to FIG. 16, a fifth embodiment display assembly 130 has two feet 132 and 134 similar to the sixth embodiment foot 96 as shown in FIG. 10 and a display 46 including a lower section 136, a center section 138 and an upper portion 140, which are constructed of wire. The display 46 includes two cross members 142 and 144, which are also constructed of wire. The display 46 further includes a display member 52 having a sign 60 attached to the upper section 140.

Figure 17:
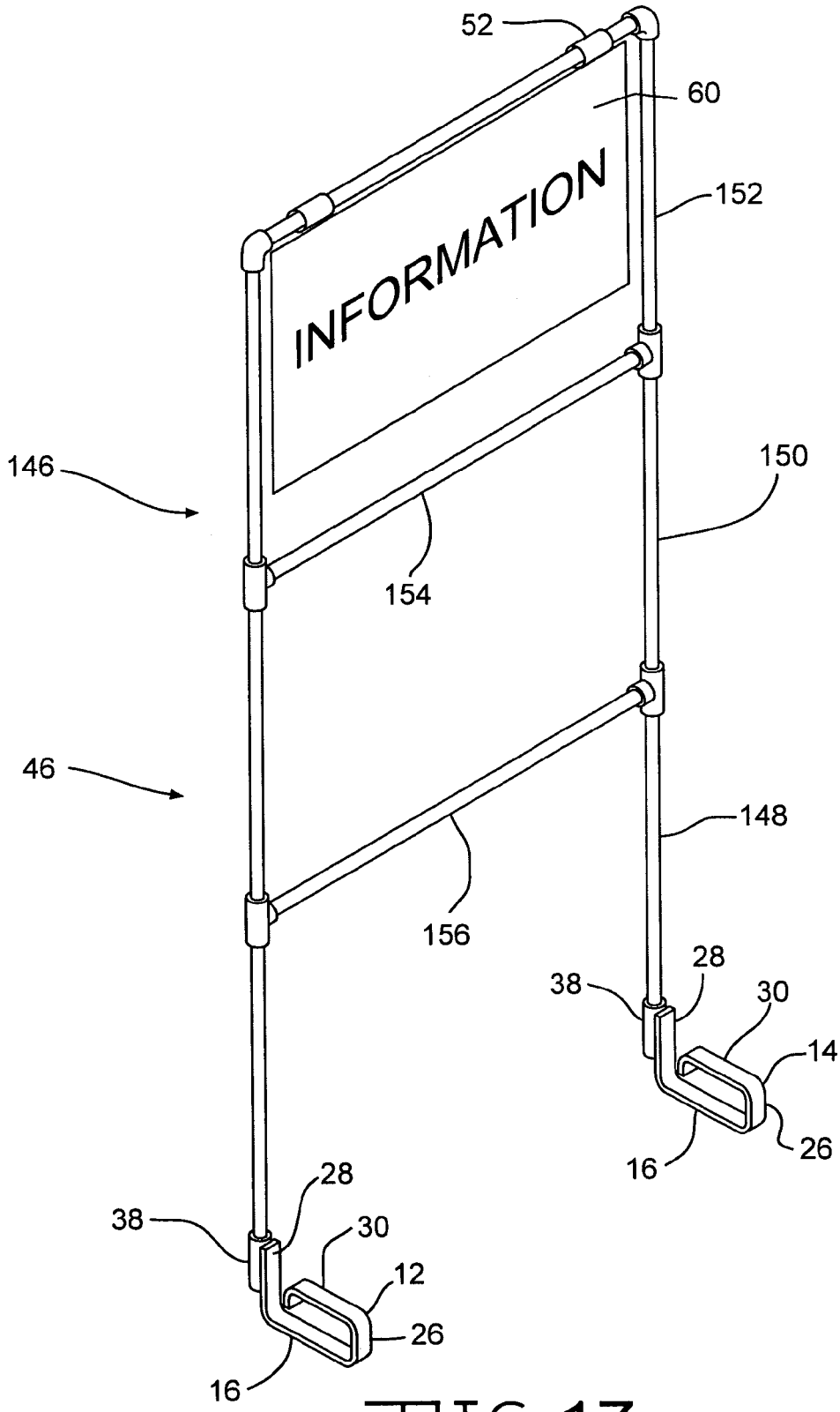
FIG. 17 is a perspective view of a sixth embodiment display assembly according to the present invention.

Referring to FIG. 17, a sixth embodiment display assembly 146 has a first foot 12 and a second foot 14. A display 46 including a bottom section 148, a middle section 150 and a top section 152 are positioned on the first and second feet 12 and 14. The display 46 further includes two cross members 154 and 156. A display member 52 having a sign 60 is positioned on the top section 152. The bottom, middle and top sections 148, 150 and 152 and the cross members 154 and 156 are constructed of plastic tubing.

While the invention as been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

The invention claimed is:

1. A display assembly comprising:

at least one foot having a base member including a first end and a second end, a first member extending upwardly from the first end, a second member extending upwardly from the second end, the second member having an interior surface facing toward the first member and an exterior surface facing away from the first member, a resilient clamping member extending upwardly from the first member toward the second member and a display holder being positioned on the exterior surface of the second member, the display holder being substantially cylindrical; and a display for positioning on the display holder, the display having a display support member and a display member.

2. The display assembly of claim 1, wherein the base member has a substantially flat lower surface.

3. The display assembly of claim 1, wherein the base member has a substantially rounded lower surface.

4. The display assembly of claim 1, wherein the first end and the second end are positioned in an opposed and spaced relationship with respect to one another.

5. The display assembly of claim 1, wherein the clamping member has a substantially flat top surface.

6. The display assembly of claim 1, wherein the clamping member has a substantially rounded top surface.

7. The display assembly of claim 1, wherein the foot has a third member extending downwardly from the clamping member toward the base member.

8. The display assembly of claim 1, wherein the display holder has a side wall and a bottom, the side wall defining an opening for positioning of the display.

9. The display assembly of claim 1, wherein the display support member has a top and a bottom, the top being adapted for supporting the display member, the bottom being adapted for positioning in the display holder.

10. The display assembly of claim 1, wherein the display support member has a first section and a second section.

11. The display assembly of claim 10, wherein the display support member has a locking device to secure the first section to the second section.

12. The display assembly of claim 1, wherein the display assembly has two feet.

13. The display assembly of claim 12, wherein at least one frame member extends between the second members of the two feet.

14. The display assembly of claim 12, wherein the display assembly has a first said display holder positioned adjacent to the second member of the first foot and a second said display holder positioned adjacent second member of the second foot.

15. A display assembly comprising:

two feet, each foot having a base member including a first end and a second end, a first member extending upwardly from the first end, a second member extending upwardly, from the second end, the second member having an exterior surface facing away from the first member, and a resilient clamping member extending from the first member toward the second member;

at least one frame member extending between and attached to the exterior surface of the second members of the two feet a display holder being attached to the at least one frame member; and a display for positioning on the display holder.

16. A display assembly comprising:

a first foot and a second foot, each foot having a base member including a first end and a second end, a first member extending upwardly from the first end, a second member extending upwardly from the second end, a resilient clamping member extending from the first member toward the second member;

a first display holder positioned adjacent to the second member of the first foot and a second display holder positioned adjacent to the second member of the second foot, the first display holder and the second display holder being substantially cylindrical; and a display for positioning on the first and second displays holders, the display having a first display support member positioned in the first display holder and a second display support member positioned in the second display holder, the display further including a display member extending between the first and second display support members.

17. The display assembly of claim 16, wherein the display member has a sign.

* * * * *

UNITED STATES PATENT AND TRADEMARK OFFICE

CERTIFICATE OF CORRECTION

PATENT NO. : 7,617,627 B1
APPLICATION NO. : 11/259330
DATED : November 17, 2009
INVENTOR(S) : John D. Waidelich It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 694 days.

Signed and Sealed this

Nineteenth Day of October, 2010

David J. Kappos

David J. Kappos
*Director of the United States Patent and Trademark Office*